US008561536B2

(12) United States Patent
MacFarlane

(10) Patent No.: US 8,561,536 B2
(45) Date of Patent: Oct. 22, 2013

(54) STOCHASTICALLY LASERED FILM ROLLER

(75) Inventor: Graham MacFarlane, Neunkirchen-Seelscheid (DE)

(73) Assignee: Felix Boettcher GmbH & Co. KG, Cologne (DE)

( * ) Notice: Subject to any disclaimer, the term of this patent is extended or adjusted under 35 U.S.C. 154(b) by 582 days.

(21) Appl. No.: 12/309,420

(22) PCT Filed: Jul. 18, 2007

(86) PCT No.: PCT/EP2007/057420

§ 371 (c)(1), (2), (4) Date: Jul. 22, 2009

(87) PCT Pub. No.: WO2008/009699

PCT Pub. Date: Jan. 24, 2008

(65) Prior Publication Data

US 2009/0320700 A1 Dec. 31, 2009

(30) Foreign Application Priority Data

Jul. 19, 2006 (EP) ..... 06117496

(51) Int. Cl.
*B41N 7/06* (2006.01)

(52) U.S. Cl.
USPC ..... 101/352.13; 101/352.11; 492/30; 492/37

(58) Field of Classification Search
USPC ..... 101/352.1, 352.11, 352.13; 492/30, 37
See application file for complete search history.

(56) References Cited

U.S. PATENT DOCUMENTS

| | | | | |
|---|---|---|---|---|
| 3,924,313 | A * | 12/1975 | Broderick | 492/37 |
| 4,793,041 | A | 12/1988 | Jenkins et al. | |
| 5,429,046 | A * | 7/1995 | Shiba et al. | 101/148 |

FOREIGN PATENT DOCUMENTS

| | | | |
|---|---|---|---|
| CA | 2026897 | | 5/1991 |
| DE | 198 47 108 | | 4/2000 |
| DE | 101 03 842 | | 10/2001 |
| EP | 0 425 829 | | 5/1991 |
| EP | 0 662 394 | | 1/1994 |
| EP | 0 594 016 | | 4/1994 |
| FR | 2 449 484 | | 9/1980 |
| GB | 2 044 398 | | 10/1980 |
| JP | 55-117688 | | 9/1980 |
| JP | 60-144923 | | 9/1985 |
| JP | 1110991 | | 4/1989 |
| JP | 1234295 | | 9/1989 |
| JP | 2086496 | | 3/1990 |
| JP | 3-178366 | | 8/1991 |
| JP | 6023965 | | 2/1994 |
| JP | 6-171261 | | 6/1994 |
| JP | 9262965 | | 10/1997 |
| JP | 9314810 | | 12/1997 |
| JP | 2001129970 | | 5/2001 |
| JP | 20021032554 | | 4/2002 |
| JP | 2007229683 | A * | 9/2007 |

* cited by examiner

*Primary Examiner* — Leslie J Evanisko
(74) *Attorney, Agent, or Firm* — Jacobson Holman, PLLC

(57) ABSTRACT

A film roller for offset printing having a surface with projections and recesses, characterized in that said projections and recesses form an irregular random pattern.

9 Claims, 2 Drawing Sheets

STOCHASTICALLY LASERED FILM ROLLER

This is a 371 of PCT/EP2007/057420 filed Jul. 18, 2007.

The invention relates to film rollers, processes for the preparation of the film roller, and the use thereof.

In offset printing machines, rollers are employed for transferring the ink from the ink cartridges. Typically, the first roller, called ink duct roller, takes up ink from the ink duct and transfers it to a film roller, wherein the distance between the ink duct roller and the film roller makes sure that only a particular fraction of the provided ink is transferred further.

Between the ink duct roller and the film roller as well as between the film roller and the following transfer roller, the printing ink must separate. Ink is frequently spattered at the separating sites. Due to the fact that the ink is not completely removed from the film roller, the roller becomes overloaded with ink, which is slung off in an uncontrolled manner. For ensuring the ink transfer and reducing the slinging off, structured surfaces have been employed in the prior art, for example, film rollers having diamond profiles and spiral groove profiles; see DE 101 03 842.

The structured surfaces of corresponding film rollers essentially serve for controlling the ink quantities transferred between the rollers. Various pitches of such profiles were tested that have some influence on the problem of ink misting or spraying, without achieving any concrete progress. In addition, the higher intensity of the profiles brought about problems with non-uniform ink transfer or some streaking, which were attributed to the surface structures.

Further, an increased abrasion of the elastomer roller in contact with the film roller as well as substantial problems with the cleaning of structured rollers have been established.

EP 0 594 016 B1 describes liquid-feeding rollers having a stochastic pattern in intaglio printing.

The object of the present invention is to provide a device and process by which the mentioned drawbacks of the prior art are overcome.

This object is achieved by a film roller for offset printing having a surface with projections and recesses, wherein said projections and recesses commonly form an irregular random pattern.

According to the invention, the film roller has irregular random patterns that form projections and recesses on the surface. Such patterns are also referred to as stochastic patterns. They are produced, for example, by removing small areas from a given material on a roller surface by a processing step, and the processing direction of the tool changes in a random fashion; thus, the decision about the change of direction is made randomly, for example, by computer control. With respect to the original level of the surface, both recesses and, by displacing material, projections rising beyond the original surface are formed according to the invention. As can be seen from the Figures, the recesses form canals on the surface. Maze-like structures are formed. As in the Figures, the projections also form contiguous areas.

In particular, the film roller according to the invention has no regular patterns. The structure is defined not only by, for example, a diameter or depth, but the structural motif additionally changes the course of its direction randomly on the surface.

U.S. Pat. No. 4,793,041 describes a film roller into which cylindrically shaped holes are introduced by means of a pulsed laser. In contrast to the present invention, although this leads to irregular holes, it does not lead to an irregular random pattern on the surface of the roller. In addition, only holes are formed, so that no projections are produced in contrast to the invention.

FR 2,449,484 describes a roller which has crevices or clefts in partial areas of the surface, wherein the surface consists of metal, and up to 30% of the surface may be covered by crevices. Thus, FR 2,449,484 does not describe projections and recesses, because the polished area does not have any projections with respect to the roller surface.

EP 0 662 394 describes superpositions of several regular patterns. Although it is described that the tool with which the patterns are applied may have an irregular shape, there is still a regular pattern on the surface even when this tool is used.

The film roller according to the invention preferably has a peak-to-valley height, $R_z$, as measured according to DIN EN ISO 4287 within a range of from 200 to 1000 μm, preferably from 400 to 700 μm. The surface of the film roller may consist of various materials, wherein polymers, such as polyamide or polyurethane, or copper, ceramics or brushed chromium are particularly suitable.

For describing the surface structure, the filling volume is also suitable, in particular. Thus, a topographical image is examined, wherein an elevation value of 0 is assigned to the middle level of the topographical image. In this way, a filling volume can be calculated that is considered a measure of the surface structure. This filling volume is then expressed as volume (free volume) per surface area and referred to as $V_1$ in the following. Preferred free volumes $V_1$ are from 0.005 to 0.5 $mm^3/mm^2$, more preferably from 0.01 to 0.15 $mm^3/mm^2$.

It is also possible to calculate a filling volume to a complete filling of the surface, i.e., between the deepest and highest profile values. This is referred to as $V_2$ in the following. Preferred volumes are from 0.02 to 1.5 $mm^3/mm^2$, more preferably from 0.06 to 1.0 $mm^3/mm^2$.

Figure 5:
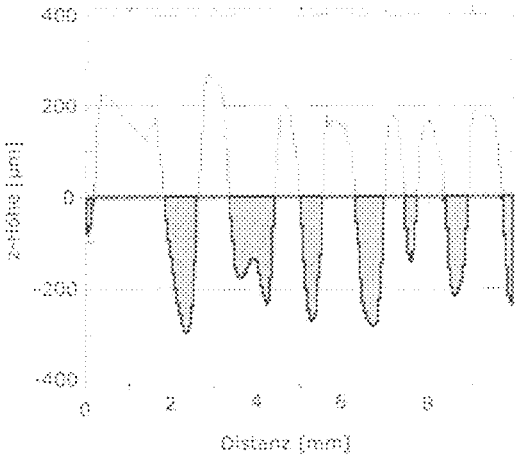
Figure 6:
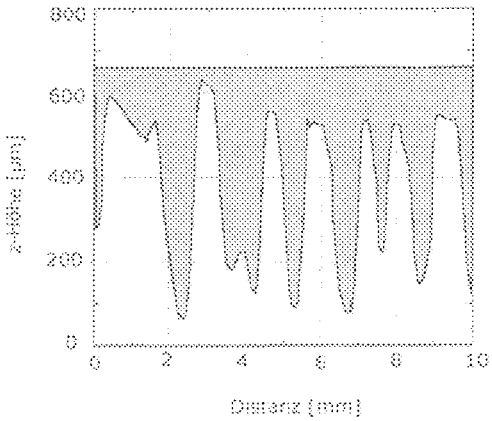

By means of a sketch, FIGS. 5 and 6 show the differences between the filling volumes $V_1$ and $V_2$. The calculated volume is respectively represented by the gray areas.

Typically, the arithmetic mean of the widths of the canals is around 0.1 and up to 1 mm. The arithmetic mean of the depth of the canals is within a range of from 0.1 to 0.5 mm. Typically, the width of the webs is within a range of from 0.3 to 8 mm, preferably from 0.5 to 3 mm. Preferably, the width and depth are matched to one another in such a way that the arithmetic means of the width and depth are in a ratio of from 3:1 to 1:2.

In a preferred embodiment, the projections and recesses form an irregular random pattern that has a smaller free volume in the peripheral areas of the film roller. This is reasonable especially when so-called "narrow lanes" are operated in the printing machine, i.e., lanes that do not occupy the entire width of the roller. This causes problems in that the transferred ink in the peripheral areas, in which the ink is not taken off, is slung off, dried, etc.

Therefore, there is preferably a lower free volume in the peripheral areas of the film rollers, for example, lower by 20% as compared to the middle area, preferably lower by 10% as compared to the middle of the roller. Thus, less ink is transferred in the peripheral areas when a narrow lane is operated. If such a roller is employed for a full lane, this lower free volume can be compensated for by opening the ink key and also otherwise by an increased ink supply in these peripheral areas.

The invention further relates to an ink unit comprising a film roller according to the invention. Ink units mostly comprise a high number of rollers with which the amount and quality of the ink application is controlled.

Therefore, in addition to an ink duct roller, the film roller according to the invention and a forme roller, the ink unit according to the invention also comprises further rollers as known in the prior art.

The invention further relates to a process for the preparation of the film roller according to the invention, comprising the step of treating the surface with a laser to produce an irregular random pattern of projections and recesses.

The invention further relates to a process for the transport of a printing ink in offset printing, comprising the following steps:

transport of a printing ink from an ink duct onto an ink duct roller;

transport of the printing ink from the ink duct roller onto a film roller having a surface with projections and recesses that form an irregular random pattern.

Surprisingly, the film roller according to the invention and the process according to the invention succeed in performing the ink transport with improved efficiency. This means that less ink remains on the film roller, which ultimately results in less spattering because less ink must be transported.

In addition, surprisingly, the film rollers according to the invention are readily cleaned.

In addition, the stochastic pattern has the effect that less attrition occurs with the film rollers according to the invention.

In a particularly preferred embodiment, when said irregular random patterns are formed, it is taken care that no areas of projections having a length of ≥3 mm remain in a range of from 0 to 45° with respect to the axis of rotation of the roller. In this way, the formation of webs that are transverse to the roller's running direction over a larger area is prevented.

The invention is further illustrated by means of the following Examples.

Figure 1A:
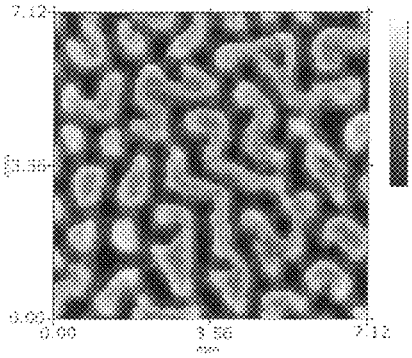
FIGS. 1*a*, 1*b*, 2*a*, 2*b*, 3*a*, 3*b*, and 4*a* are topographical representations of film roller surfaces in accordance with the invention.
Figure 1B:
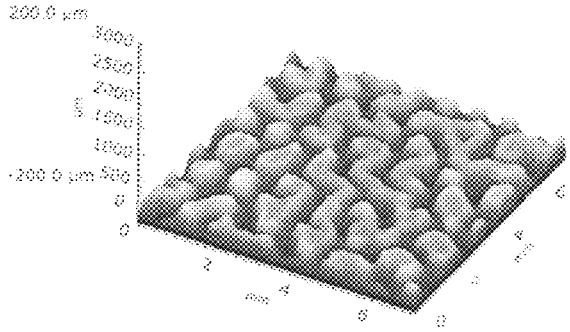

EXAMPLE 1 roller having a polyamide surface coating and a diameter of about 55 mm was irradiated by means of a $CO_2$ industrial laser (VWA 1200 of the company Baasel, Starnberg, Germany) with 400 W. Thus, the roller was rotated, and the laser was passed stochastically over the surface. The topography of the thus obtained surfaces was measured. FIGS. 1*a* and 1*b* show a corresponding representation. Subsequently, the peak-to-valley heights were measured. The Rz as measured by DIN EN ISO 4287 was 415 μm.

Subsequently, a corresponding profile was measured at a sectional line in a topographical image. The filling volumes were calculated as the volume from the recesses to the zero line (middle between the deepest recess and highest projection). Based on a surface area of 50.69 $mm^2$, the free volume was 2.192 $mm^3$. This corresponds to a free volume $V_1$ of 0.043 $mm^3/mm^2$ and $V_2$ of 0.182 $mm^3/mm^2$.

EXAMPLE 2

Subsequently, a roller was treated again with 400 W as in Example 1. However, the profile was extended by computer modulations by 75%, so that the valleys and ridges become broader.

Figure 2A:
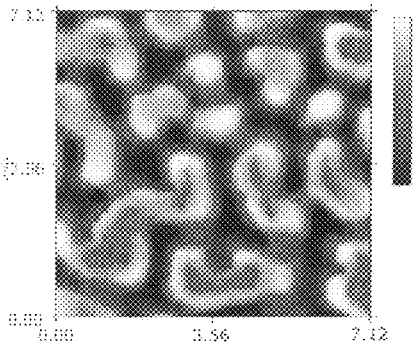
Figure 2B:
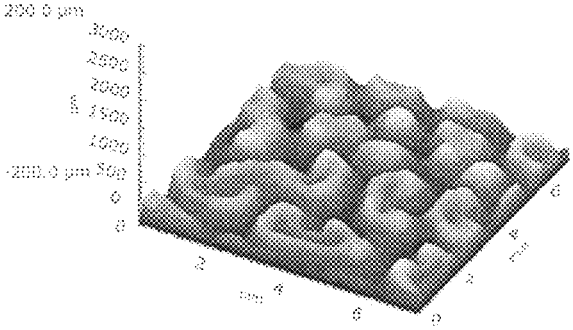

FIGS. 2*a* and 2*b* show a corresponding representation of the thus obtained profile. The roller was again measured. The peak-to-valley height Rz according to DIN EN ISO 4287 was 496 μm. Subsequently, a topographical image was again prepared and measured as described in Example 1. A volume of 2.617 $mm^3$ was found on a surface area of 50.69 $mm^2$. This again corresponds to a free volume $V_1$ of 0.052 $mm^3/mm^2$ and a free volume $V_2$ of 0.264 $mm^3/mm^2$.

EXAMPLE 3

A roller like that in Example 1 was treated with a power of 600 W, so that the recesses become deeper.

Figure 3A:
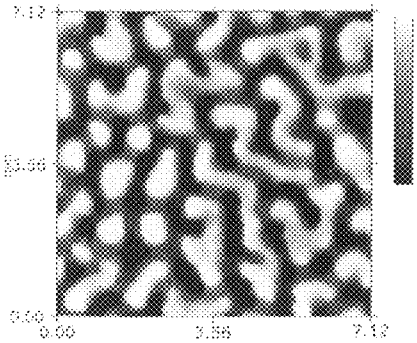
Figure 3B:
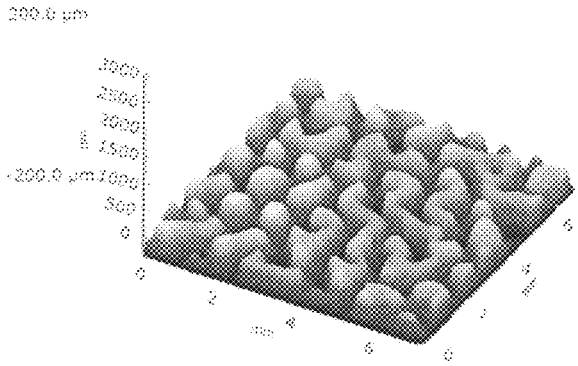
Figure 4A:
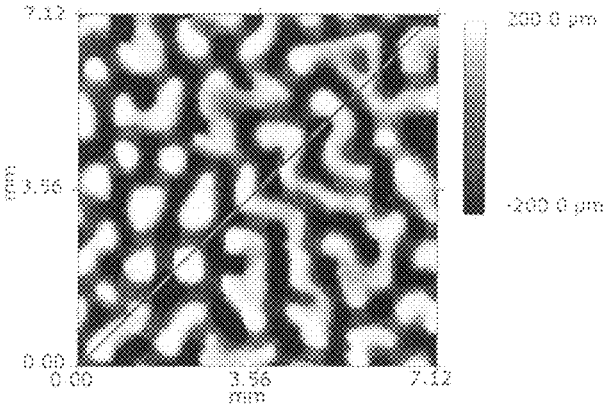
Figure 4B:
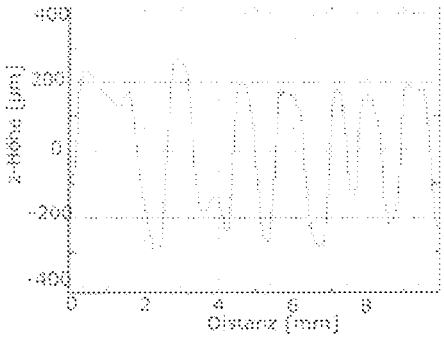
FIGS. 4*b*, 5, and 6 graphically depict the surface profile along the sectional line shown on FIG. 4*a*.

FIGS. 3*a* and 3*b* show a corresponding topographical image. Using this image, the peak-to-valley heights were again measured. An Rz according to DIN EN ISO 4287 of 613 μm was found. Subsequently, a topographical image was measured for the filling volume. This is shown in FIGS. 4*a* and 4*b*. A volume of 3.511 $mm^3$ was found on a surface area of 50.69 $mm^2$. This corresponds to a free volume of 0.069 $mm^3/mm^2$ and a free volume $V_2$ of 0.292 $mm^3/mm^2$.

As compared to a non-laser-treated surface, an improved evacuation of the recesses of the film roller, less spattering of the ink, less attrition with the subsequent elastomer-coated roller, an improved cleaning performance and a higher uniformity of the transferred ink film and thus increase of the printing quality, especially for sensitive subjects, were found when the roller was used.

The invention claimed is:

1. A film roller for offset printing having a surface comprising a structural motif obtained by displacing material from the roller's original surface to form a surface pattern of directionally random projections, having irregular height above the original surface level, and recesses, having irregular depth below the original surface level, wherein said projections and recesses cooperatively form an irregular maze of directionally random canals in the film roller surface.

2. The film roller according to claim 1, wherein ifs the projections and recesses peak-to-valley height, $R_z$, is from 200 to 1000 μm.

3. The film roller according to claim 1, wherein the surface of the film roller consists of polyamide, polyurethane, copper, ceramics or brushed chromium.

4. The film roller according to claim 1, wherein the projections and recesses free volume $V_1$ is from 0.005 to 0.5 $mm^3/mm^2$.

5. The film roller according to claim 1, wherein the projections and recesses have a free volume $V_1$, wherein the free volume $V_1$ in the peripheral area of the roller is lower by 20% as compared to the middle of the roller.

6. An ink unit comprising an ink-duct roller, a forme roller and a film roller according to claim 1.

7. A process for preparing a film roller according to claim 1, comprising the step of treating the roller's original surface with a laser to produce the dimensionally random surface pattern of projections and recesses.

8. A process for the transport of a printing ink in offset printing, comprising the following steps:

transport of a printing ink from an ink duct onto an ink duct roller;

transport of the printing ink from the ink duct roller onto a film roller according to claim 1.

9. A film roller for offset printing having a topographically stochastic surface structure of irregular directionally random projections, having irregular height above the original surface level, and recesses, having irregular depth below the original surface level, formed by displacing material from the original roller's surface, wherein the projections cooperate with the recesses to form a maze of surface canals.

* * * * *